United States Patent [19]

Thompson

[11] Patent Number: 4,489,841

[45] Date of Patent: Dec. 25, 1984

[54] TAMPER EVIDENT CLOSURES AND PACKAGES

[75] Inventor: Mortimer S. Thompson, Arlington, Mass.

[73] Assignee: Tri-Tech Systems International, Inc., West Springfield, Mass.

[21] Appl. No.: 467,791

[22] Filed: Feb. 18, 1983

[51] Int. Cl.[3] ..... B65D 55/02

[52] U.S. Cl. ..... 215/203; 215/230; 215/365

[58] Field of Search ..... 215/203, 230, 365, 367

[56] References Cited

U.S. PATENT DOCUMENTS

| | | | |
|---|---|---|---|
| 2,201,205 | 5/1940 | Samburg | 215/230 |
| 2,939,597 | 6/1960 | Greene | 215/230 |
| 2,939,597 | 6/1960 | Greene | 215/230 |
| 3,433,152 | 3/1968 | Mullen et al. | 101/28 |
| 3,468,744 | 9/1969 | Reinhart | 428/913 |
| 3,887,734 | 6/1975 | Chazan | 428/40 |
| 3,896,965 | 7/1975 | Cornell | 220/359 |
| 3,899,295 | 8/1975 | Halpern | 206/459 X |
| 3,923,198 | 12/1975 | Brochman | 220/359 |
| 3,935,960 | 2/1976 | Cornell | 220/260 |
| 4,424,911 | 1/1984 | Resnick | 215/365 |
| 4,436,213 | 3/1984 | Paul et al. | 215/365 |

*Primary Examiner*—Donald F. Norton

*Attorney, Agent, or Firm*—Hedman, Gibson, Costigan & Hoare

[57] ABSTRACT

A tamper evident closure and package including a resealable closure (10) for closing, opening and reclosing a container, color changing means (32*a* in FIGS. 1–6) which effect a color change upon stretching, and coacting mechanical means (24, 36, 44 and 46 in FIGS. 1–6) for uncapping and recapping the closure 10 and for stretching the color changing means (32*a*) which clearly and unequivocally indicate the condition of the package, e.g., open or closed.

Where legends, or other well defined indicia, indicating opening is desired, the color changes can be localized in the skirt by providing thin sections (32*a*) which stretch preferentially and adjacent thicker sections (38) which remain substantially unstretched. The thin sections (32*a*) for example can be a legend, or alternatively the thick sections (38) can be the legend while the thin sections (32*a*) provide a suitable background.

The color changes employed by the invention can be accomplished by such phenomena as stress whitening inherent in various plastic materials. Alternatively, the color changes can be accomplished by mechanisms such as the use of encapsulated staining or coloring agents incorporated in a suitable matrix.

53 Claims, 38 Drawing Figures

TAMPER EVIDENT CLOSURES AND PACKAGES

FIELD OF THE INVENTION This invention relates to tamper evident closures and packages for indicating the condition of the packages and particularly to caps for containers or bottles having a stretchable portion which changes color to provide a clear and unequivocal indicator of the condition of the container or bottle, e.g., that it has been opened or tampered with.

BACKGROUND OF THE INVENTION

The need for evidence of tampering with packaged products has been a perennial problem and with merchandizing activities more and more centered in large, unsupervised markets the need is greater than ever.

In general, commercially available tamper evident closures for capped containers and bottles have not been satisfactory. They are costly, require additional packaging operations, compromise recycling, may be harmful and give ambiguous results. One or more of these drawbacks are present in currently available seals, bands and multicomponent or multifunctional caps.

One current method for producing such evidence in bottled products calls for the use of wafer-like seals under the cap, sealed to the bottle opening and barring access to the bottle contents until removed. Various methods of application and materials are used for a variety of products. Another method uses a plastic or metal band intimately covering the cap and adjacent neck to prevent access to the cap without removal of the band. Such methods are popularly used on bottles for wine and medicinal products. These wafer-like seals and external bands perform the task of producing evidence of tampering but only if the purchaser or user is familiar with the makeup and appearance of the unopened package because these items are separable from the primary package of cap and bottle and no explicit evidence remains. An additional handicap of such devices is the extra cost in materials, packaging machinery and the cost of operating such machinery.

Another method of providing tamper-evidence to bottles is the use of caps with extended skirt portions which engage restraining features in the bottle neck and which must be torn away in order to remove the cap. This method also suffers from the handicap that no explicit evidence of tampering remains with the primary package, and additional costs are incurred for the extended skirt tearaway feature and the modification to the bottle neck and capping machinery.

Other methods for producing tamper evidence in containers are accomplished using a perforated breakaway lower skirt portion of a metal or plastic cap which is broken away on cap removal and subsequently retained on the bottle neck. This leaves the evidence of tampering on the package where, upon examination, it can be seen as a separated portion of the cap with the implications of tampering. However, plastic caps having this feature may present the problem of indicating tampering falsely when the rings are broken by some other means, such as with soft drinks when simple removal of the bottle from multipackage carriers (which grip the bottle below the cap) break the tamper evidence ring. Metal caps, on the other hand, leave a metal ring on the bottle neck which can have sharp edges and which also present a recycling problem for the bottle. Efforts to solve this problem have resulted in a metal cap with a lower skirt portion which splits radially to leave the cap in one piece when the bottle is opened.

Unfortunately, solving the one problem has led to another which is the difficulty in determining whether the bottle has been opened since a careful examination is required, in most instances, to determine whether the skirt has split. Additionally, the effectiveness of the breakaway or split skirt feature in metal caps is a function of the control over the operation of forming the threads and breakaway feature. These are configured "in situ" on the bottle neck by a "roll-on" mechanism. Some incidence of faulty threads and tamper evidence features are known to occur during this operation which may lead to the faulty conclusion that bottles have not been tampered with.

In addition to the current commercial efforts, the patent literature discloses that evidence of bottle tampering may be provided by legends on the closures which express that the container has been opened. (See, for example, U.S. Pat. Nos. 2,201,205 and 2,939,597). These methods, however, are expensive and are based upon closures which require multicomponent assemblies calling for special bottle neck designs.

Other tamper-evident closures are disclosed in U.S. Pat. Nos. 3,935,960, 3,923,198 and 3,896,965. These patents disclose tape closures produced from plastic sheets which adhere to cans and which indicate the cans have been opened by a color change that takes place in the closure where it has been pulled and stressed during removal. The color change mechanism is accomplished in one case through the use of encapsulated coloring agents dispersed in the plastic and in the other case through the use of plastics which exhibit the phenomenon known as stress whitening or opacification as disclosed in U.S. Pat. Nos. 3,433,152, 3,468,774 and 3,887,734. As a tape primary closure these methods are limited by their form and method of application to generally non-resealable containers. As a tape secondary closure they would behave as the "tamper evident" bands discussed above and have the same drawbacks of leaving no explicit evidence of tampering after removal and requiring multicomponent and costly assemblies.

Thus, known tamper-evident closures and packages are beset with drawbacks.

SUMMARY OF THE INVENTION

In accordance with the present invention there is provided a new and unique tamper evident closure and package which provides clear and unequivocal evidence of the condition of the package. The package includes a resealable substantially rigid closure for closing, opening and reclosing a container, color changing means which changes color upon stretching, and coacting mechanical means on the closure and container for uncapping and recapping said closure and for stretching said color changing means to produce a change in color which indicates the condition of the package. Preferably, the color changing means is on the closure and changes color to indicate the condition of the package upon movement of the closure, e.g., in removing the closure to open the container.

In a preferred embodiment, the closure of the invention is a cap including a top and a depending skirt which engages the finish of a container or bottle to seal the container and which includes means to tensile stress at least a portion thereof to cause the color change and indication that it has been opened. The skirt can be tensile stressed by means thereon which engage the finish and produce an interference to removal of the cap. In overcoming the interference the color changing stress is provided.

Where legends, or other well defined indicia, indicating opening is desired, the color changes can be localized in the skirt by providing thin sections which stretch preferentially and adjacent thicker sections which remain substantially unstretched. The thin sections for example can be a legend, or alternatively the thick sections can be the legend while the thin sections provide a suitable background.

To facilitate uniform stretching of the thin skirt sections judiciously located slots can be included which separate segments of the thick portions to provide complete mobility of the legend producing cap portion during stretching. Preferably the thin skirt sections can be shaped or slanted so that their boundaries with the thicker substantially unstretched sections are on a bias with the direction of the applied stress, e.g., individual letters or indicia can be slanted or otherwise distorted from traditional, vertical, straight-edged shapes.

In a preferred embodiment for a threaded cap, mechanical engagement means between cap skirt and bottle neck develops the needed stretching by translating a twisting motion into a tensile stress on the cap skirt in the area of the legend or indicia which is below the threads and above a projection which engages a ring or other projection on the bottle neck. The projection preferably has an angle about the same as the threads of the cap so that it engages the projection on the bottle neck in a point by point manner to minimize the force needed to overcome such engagement while producing the required stretching and color change in the legend.

In a preferred embodiment for a snap cap, the mechanical engagement means between the cap skirt and bottle neck develops the needed stretching of the cap skirt by using the interference created by the cap's internal sealing projection located below the legend with the bottle neck's external sealing bead. By placing the cap lift tab directly above the legend, the legend is subjected to sufficient tensile stress on opening to stretch the legend area below and adjacent before the cap is unseated thereby effecting the color changing evidence of opening.

In other embodiments, the action in closing a twist or snap cap can be used to produce a legend or indicia that the cap is closed, e.g. "SEALED", and then the action in opening the twist or snap cap can be used to produce indicia or a legend to indicate the cap is opened, e.g., "UN" can be produced to provide a legend which reads "UNSEALED". Thus, the invention can be used to indicate the general condition of packages, particularly whether they have been opened or have remained unopened.

In the invention, moreover, the color changing portion of the closure or cap can be an integral part thereof including all of it or it can be applied to the closure or cap surface as a coating, laminate or the like. In each embodiment, however, the color changing portion is a permanent part of the closure or cap. Also, the color changing portion can effect the legend directly or by providing a background for the legend which can be painted thereon or which can include thicker unstretchable portions therewithin.

In certain embodiments the color change is used to create a legend such as the word "opened" on the bottle cap as it is removed from, or "sealed" as it is applied to the container. In other embodiments the color change is used to change a legend, such as changing the word "unopened" to "opened" or "sealed" to "unsealed". Other legends and symbols can be created to practice the invention or the invention can be practiced by the creation of undefined areas of color change which do not depend on adjacent thick and thin sections.

The color changes employed by the invention can be accomplished by such basic phenomena as stress whitening inherent in various plastic materials. Alternatively, the color changes can be accomplished by mechanisms such as the use of encapsulated staining or coloring agents incorporated in a suitable matrix.

An important feature of the invention is that the proof of prior opening is very noticeable. Its prominent location on the skirt of the bottle cap itself, utilizing a pronounced contrast in color, provides graphic evidence of prior opening with the practice of the present invention.

Another feature of the invention is that the proof of prior opening can be very articulate, actually spelling out the word "opened" or its equivalent in various languages or symbols.

Another important feature is that the evidence of prior opening remains as an integral part of the cap and is not torn off and thrown away. Also, the tamper evident feature of the invention is not dependent upon a prior awareness of the construction of the closure and what is the tamper evident feature.

Still another feature is that the cap of the invention is removed easily as a result of the progressive application of removal stress. The stress does not build up to a high level followed by a sudden release as with roll-on metallic caps with break away lower rings.

Correspondingly the invention can be used to provide evidence that the container is closed by spelling out the words "sealed" or "unopened" or their equivalent.

Another feature of the invention is its reliability in use while employing controlled, physical displacement of cap portions to create the opening evidence using the close dimensional tolerances possible with molded plastic caps instead of the unreliability which can be introduced by roll-on metal or heat-shrink plastic break away rings.

Another feature of the invention is that it does not require new or unusual bottle neck designs but can employ existing bottle neck finishes. At the same time the invention does not require new or unusual cap engagement means but can be practiced using both traditional snap fit or continuous or discontinuous threaded designs.

Still another feature of the invention is its versatility in that it may be used to package virtually the whole range of dry or liquid products from vacuuum packed, long shelf life products to pressurized containers such as for soft drinks or beer.

Another important feature of the invention is that it is economical. The caps may be one piece with a design which conserves material and can be produced in low cost, high volume injection molding operations. Also no separate operations are required on the packaging line for its implementation.

Furthermore, the caps of the invention can be removed from and replaced on containers using normal uncapping and recapping procedures and may be applied to containers in product packaging operations using standard capping machines and technology.

Thus, the closures and packages of the invention are relatively inexpensive, they do not require additional packaging operations, they do not compromise recycling, they are not harmful and they provide clear and unequivocal evidence of the condition of the package.

BRIEF DESCRIPTION OF THE DRAWINGS

The following is a detailed description together with accompanying drawings of illustrative embodiments of the invention. It is to be understood that the invention is capable of modification and variation apparent to those skilled in the art within the spirit and scope of the invention.

Referring now to FIGS. 1 to 6, there is shown a threaded cap 10 and a neck finish 12 of the present invention. The cap 10 includes a top or lid 14, a skirt 16 and a liner 18. Externally the skirt 16 includes flutes 22 and internally it includes threads 24 and a legend 26 created by recesses 32 and sidewalls **32*b*, which form thin sections 32*a* with slots 34 therebetween (see FIG. 5) adjacent thick portions 38. The external surface of skirt 16 opposite the legend recesses 32 is flush and gives no indication of the legend 26 which lies behind it. Under legend 26 on the lower inside periphery of skirt 16 is a projection 36 in the form of a finite ledge with a leading edge 35. Bottle cap 10** is made from a plastic which stress opacifies or stress whitens.

Figure 1:
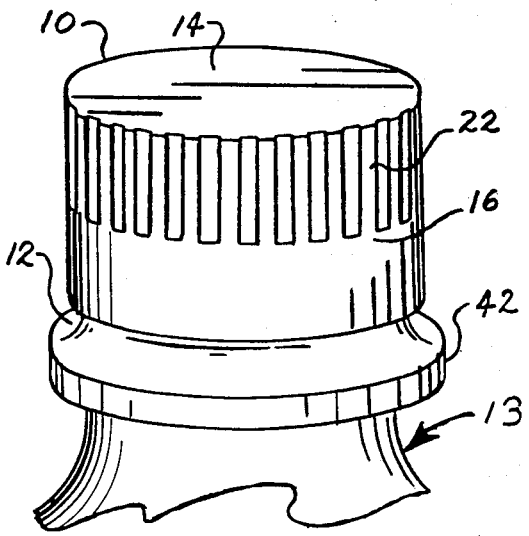
FIG. 1 is a perspective view of one embodiment of the cap of the invention on a bottle neck prior to opening.

The neck finish 12 of the partially shown bottle 13 includes a lower neck ring 42, an intermediate locking ring 44 and upper external threads 46.

Figure 2:
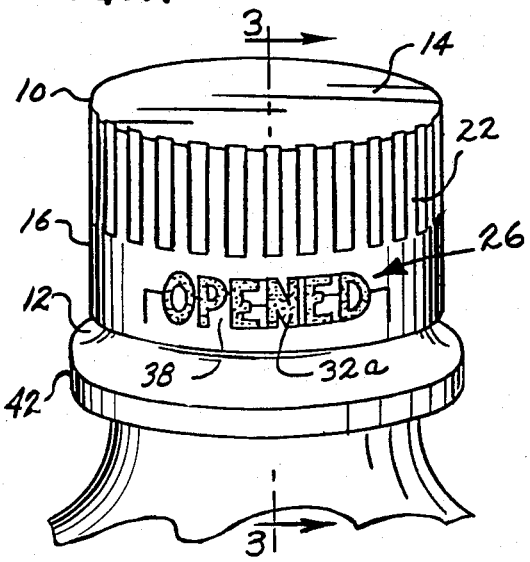
FIG. 2 is a perspective view of the bottle cap of FIG. 1 after removal and subsequent replacement, illustrating that once produced the "opened" legend remains.

In FIG. 1 the cap 10 is shown in engagement with the bottle neck finish 12 before opening. FIG. 2 shows the bottle cap 10 after it has been removed from and then replaced on the neck finish 12. The legend 26 formed by the internal recess bottoms or thin sections **32*a* is now clearly in evidence on the outside surface of skirt 16**. This results from the opacification or whitening of skirt 16 at the thin sections or recess bottoms 32*a* which, in turn, is caused by tensile stresses and the resultant strain created in removal of the cap 10.

Figure 3:
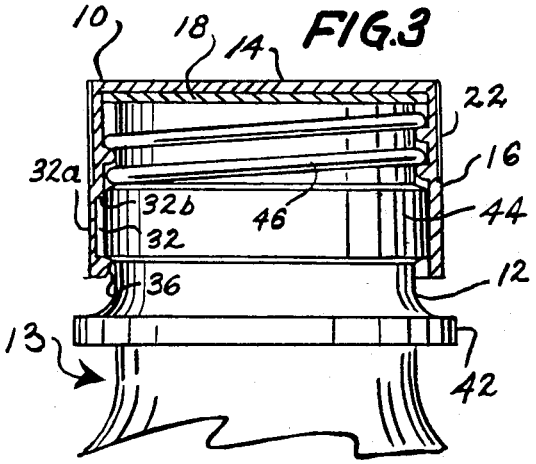
FIG. 3 is a cross-sectional view of FIG. 2 taken along the line 3—3 thereof.
Figure 4:
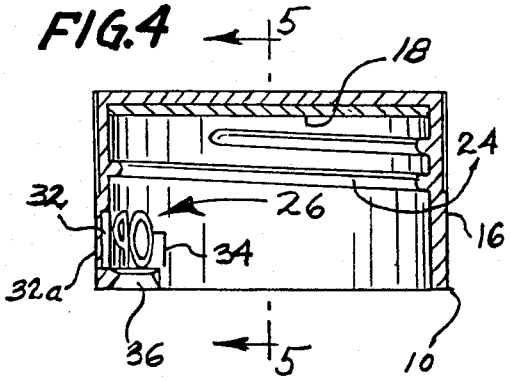
FIG. 4 is a cross-sectional view of the cap as shown in FIG. 3 without the bottle.

FIG. 3 shows how the tensile stress noted above is created by the interference engagement of ledge shape projection 36 of cap 10 with the locking ring 44 of neck finish 12. The twisting action of removing cap 10 in a counterclockwise direction is translated into a vertical tensile stress on skirt 16 in the area of legend 26 by the interference engagement noted above. The recess bottoms 32*a* are thin enough (e.g., 0.003 to 0.010 inch) to yield under such stress, with the resultant strain causing whitening which is visible throughout the thin cross section. The interconnecting slots 34 are included in the legend 26 to allow all portions of the area of legend 26 to stretch freely regardless of the shape of the legend by making it possible for the thick sections 38 to move freely without whitening except in the localized slots 34 which will not materially intrude on the graphics of the legend. The configuration and dimensions of projection 36 and those of cap skirt 16 and bottle locking ring 44 are such as to develop sufficient tensile strain to develop the desired color change while permitting clearance of the interference and removal of the cap 10 at low removal torques.

Figure 6:
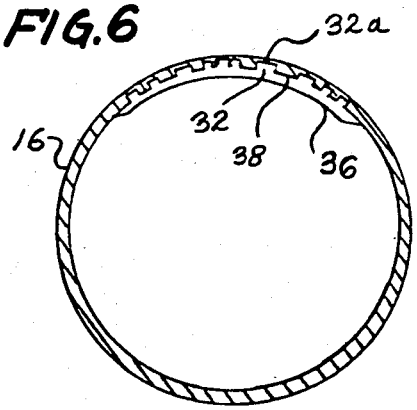
FIG. 6 is a cross-sectional view of FIG. 5 taken along the line 6—6 thereof.

Variation in vertical stretch along the length of legend 26 resulting from the engagement of the finite ledge 36 with locking ring 44 can be adjusted to assure a balanced coloration by adjusting the radial dimension of ledge 36 along its length (e.g., the trailing radial dimensions can be greater than the leading ones (see FIG. 6)).

Optionally the skirt 16 of cap 10 can be subjected to a heat source after the capping operation sufficient to cause enough shrinkage of the skirt 16 to result in intimate contact with the bottle neck 12 regardless of variations in bottle to bottle dimensions.

Figure 5:
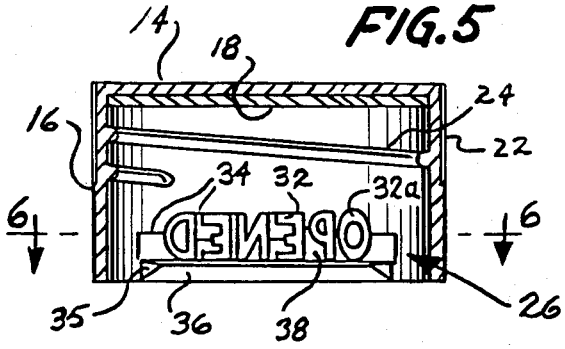
FIG. 5 is a cross-sectional view of FIG. 4 taken along the line 5—5 thereof.

FIG. 5 illustrates the location of the localized slots 34 which facilitates stretching of thin sections 32*a* for opacification thereof and movement of the thick sections 38 without significant stretching thereof. As shown, the slots 34 are transverse and generally positioned between the closest elements of adjacent letters. The number of slots 34 between adjacent letters and the total number of such slots 34, is selected for each legend to maximize opacification of the thin sections 32*a* without opacification of the thick sections 38. As also shown, slots 34 can extend on either side of or beyond the legend 26 to facilitate relative movement between the thin and thick portions.

In this embodiment of the invention, moreover, it is to be noted that as the cap 10 is initially twisted into place on neck finish 12, the stresses which are developed by the interference of projection 36 and locking ring 44 generally are compressive and, therefore, will not cause a color change in the recess bottoms 32*a* of legend 26. The thick portions 38 surrounding the thin portions 32*a* serve as bumpers to prevent buckling during such compression while the slots 34 allow the thick portions 38 to move freely apart during the tension developed on cap removal.

The circumferential stress which develops from the interference of ledge 36 with locking ring 44 during capping is a minor component and, because the ledge 36 is finite and substantially only underlies the legend 26, circumferential stretching will take place away from the area of legend 26 while the cap 10 is being applied to neck 12. In other words, the ledge 36 serves to reinforce the legend 26 in the circumferential direction so that any significant circumferential stretching will take place elsewhere. It is noted that while the ledge 36 reinforces circumferentially, it does not inhibit vertical movement of the legend 26 upon vertical stressing which is utilized to change color.

Another alternative is to make the cap 10 of non-stress opacifying plastic and to apply a thin coating or laminate of stress opacifying material to the outer surface of the legend 26 area which will perform in the same manner and produce the same color changing effects as though the entire cap was made of such plastic. The coating or laminate also can be a plastic which contains microcapsules of coloring agents which rupture to produce a coloration when stressed such as described in U.S. Pat. Nos. 3,896,965 and 3,935,960, the disclosures of which are incorporated herein by reference. A process for making the encapsulated materials is described in U.S. Pat. Nos. 3,516,841 and 3,516,946.

Figure 7:
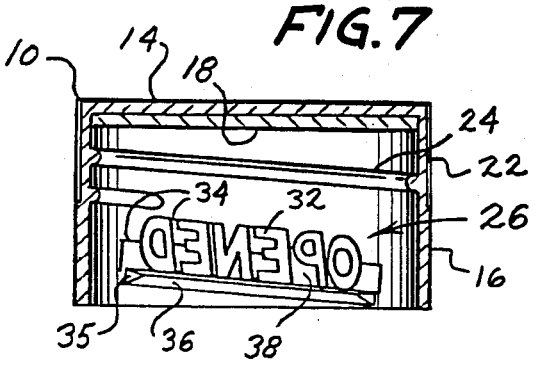
FIG. 7 is a cross-sectional view similar to FIG. 5 showing another embodiment of the cap of the invention with an inclined ledge to minimize opening torques and slanted lettering to facilitate uniform stretching therein.

FIG. 7 shows how the removal torque of the cap 10 of FIGS. 1 to 6 can be reduced by modifying the angle of the finite ledge 36 so that vertical tensile stresses are developed in a point to point progression along the ledge 36 instead of uniformly along its whole length as is the case for cap 10 of FIGS. 1 to 6. In this embodiment the leading edge 35 of ledge 36 makes first contact with locking ring 44 and vertical and circumferential tensile stress develops with resultant strain so that the leading edge 35 clears its interference engagement with locking ring 44 as the adjacent portion of ledge 36 engages the locking ring 44 and progresses along ledge 36 until it finally clears locking ring 44 completely and so on for the remainder of ledge 36 which terminates just beyond the adjacent legend 26. In this manner the torque needed to twist cap 10 is directly related to the force needed to allow a very short span of ledge 36 to clear the locking ring 44 rather than that needed to allow the whole span of ledge 36 to do so. The relative dimensions of skirt 16, ledge 36, the recesses 32, thick portions 38, slots 34 of legend 26 and the locking ring 44 are chosen to provide enough interference to assure the desired vertical strain to whiten the recess bottoms 32*a* before sufficient circumferential strain occurs for ledge 36 to clear locking ring 44.

Also shown in FIG. 7, the letter forming recesses 32 of legend 26 are slanted downwardly and forwardly relative to the alignment of ledge 36 and the threads 24 of the cap 10. This arrangement presents a bias for all recess sidewalls 32*b* to the direction of stretch. In this manner all portions of the thin recess bottoms 32*a* which form the letters of legend 26 will be directly subjected to the stretching force, even when in intimate abutment with recess sidewalls 32*b*. In this illustrative embodiment, the thin sections 32 which form the legend "OPENED" are at an acute angle with respect to the ledge 36 to provide the desired biasing. This biasing also can be realized by utilizing a stylized or distorted legend portion 26.

Figure 8:
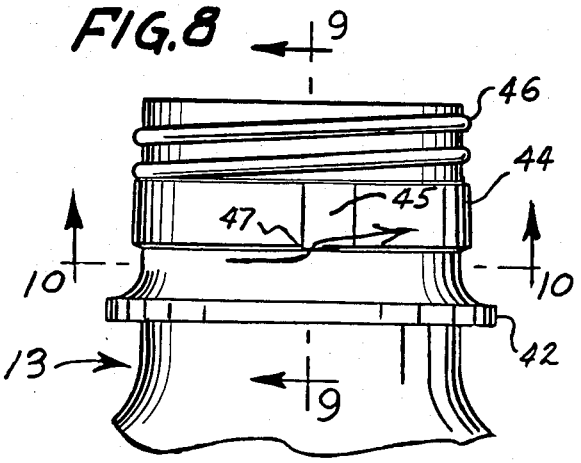
FIG. 8 is an elevational view of another embodiment of a bottle of the invention with a notched locking ring.
Figure 9:
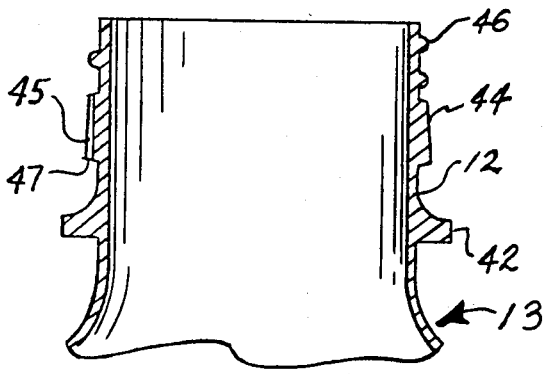
FIG. 9 is a cross-sectional view of FIG. 8 taken along the line 9—9 thereof.
Figure 10:
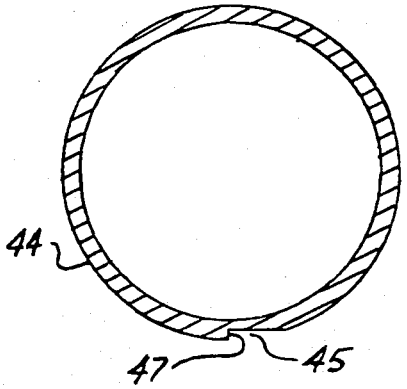
FIG. 10 is a cross-sectional view of FIG. 8 taken along the line 10—10 thereof.

FIGS. 8 to 10 show how the locking ring 44 of FIGS. 1 to 6 can be modified to insure that the desired amount of stress whitening is always obtained by making provision for a specific amount of and controlled measure of strain in thin portions 32*a* of the legend 26. A notch 45 is located on the periphery of locking ring 44 creating a lower edge 47 which acts to free ledge 36 after the desired strain in the recess bottoms 32*a* of legend 26 has been accomplished in twisting the cap 10 in the counterclockwise direction. The ledge 36, moving counterclockwise, readily disengages itself from locking ring 44 by sliding upwards past lower edge 47 into notch 45 and thence around the outer sidewall of locking ring 44 until it is fully disengaged (see path of arrow in FIG. 8). Alternatively, this same action can be developed by providing a lower edge 47 in the form of a projection on the ring 44 (not shown) which would create a following recess similar to notch 45 of FIGS. 8 to 10. In this case little or no interference to cap removal is imposed by locking ring 44 proper, but significant interference would be developed by its projection. Moreover, only a segment of the ring 44 need be included on the bottle neck 12 to achieve the foregoing.

Figure 11:
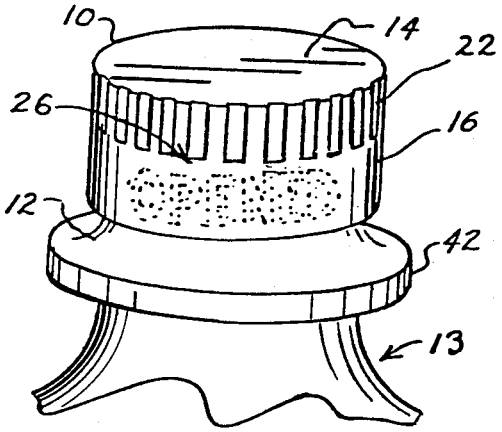
FIG. 11 is a perspective view of still another embodiment of the cap of the subject invention prior to opening in which the color changing portion provides the background for the legend.
Figure 12:
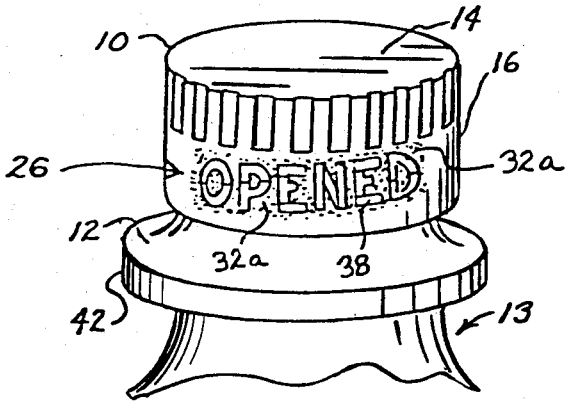
FIG. 12 is a perspective view of the cap of FIG. 11 after the cap has been removed and replaced giving a clear and continuous indication that the cap has been removed.
Figure 13:
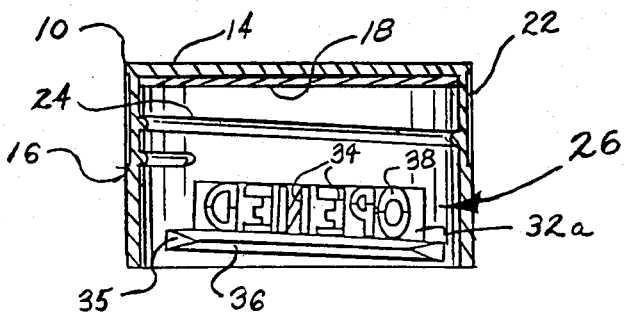
FIG. 13 is a cross-sectional view of the cap of FIGS. 11 and 12 in which the thin and thick sections of FIG. 7 have been reversed so that the color changing thin portion provides the background for the thick legend portion which remains the same color.

FIGS. 11 to 13 show the cap of FIG. 7 modified so that the color change occurs in the background to legend 26 to reveal it. This is accomplished by reversing the thick and thin skirt portions, 38 and 32*a* respectively, so that the legend 26 itself is made up of the thick portions 38 and its background is made up of thin portions 32*a*. Upon cap removal, the thin background portion 32*a* stretches and changes color revealing the legend 26 which does not change color. To facilitate free movement of all portions of the thin background 32*a* so that full definition of the legend 26 is accomplished slots 34 are provided at selected locations in thick legend sections 38. FIG. 11 shows the legend 26 in ghost representing the outline of the thick letters 38 of legend 26 on the inside wall of skirt 16 before cap removal. At this point the legend 26 is not noticeable on the outside surface. FIG. 12 shows the appearance of legend 26 on the outside surface of skirt 16, as outlined by the color change of the thin background portion 32*a* upon twist-off of the cap 10.

A suitable alternative to the mechanism for producing the legend 26 in FIGS. 11 to 13, is to replace the thick legend portions 38 with a printed coating of the same color as the skirt 16 before color change, said coated print of a non-stress opacifying material, so that it will be revealed by the color change of the thin legend background portion 32*a* upon stressing.

Figure 14:
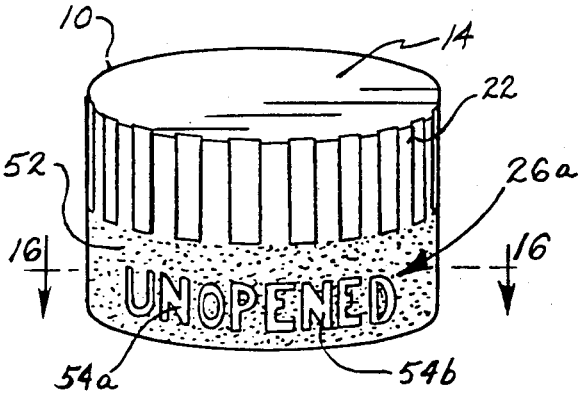
FIG. 14 is a perspective view of another embodiment of the cap of the invention prior to opening showing a legend which reads "unopened"
Figure 15:
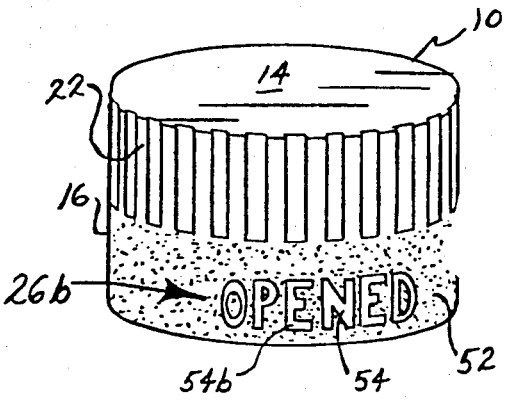
FIG. 15 is a perspective view of the cap of FIG. 14 after it has been removed from a container wherein the "un" portion of the legend changes to the color of its background while the "opened" portion is unchanged.
Figure 16:
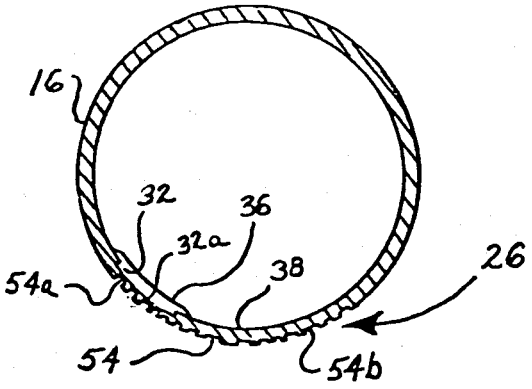
FIG. 16 is a cross-sectional view of FIG. 14 taken along the line 16—16 thereof.

FIGS. 14 to 16 show the cap 10 of FIG. 7 modified to present one legend 26*a* before opening, indicating its condition, and another legend 26*b* after opening, indicating its changed condition. FIG. 14 shows the legend 26*a* expressing an "UNOPENED" condition before opening and FIG. 15 shows the altered legend 26*b* to reveal the new "OPENED" condition after opening. In this case the lower outer portion of skirt 16 is coated with a coating 52 the color of which is different from cap 10 and identical to that which occurs when the substrate is stressed, for example, an off-white color. FIG. 16 shows all the letters of the original legend 26*a* are recessed (external recesses 54) so that the off-white coating 52 is applied only to the background of the recesses 54 of legend 26*a* which clearly defines and does not obscure them. Shown also is the fact that an internal recess 32 is located behind the letters "UN" so that the external recess bottoms 54*a* for these letters are thin and stretchable while the other letters are located in a thick portion and therefore their bottoms 54*b* are not stretchable. In this arrangement, when the cap 10 is removed, the bottoms 54*a* of the recesses which form the letters "UN" will be stretched and whitened to the same color as the external background coating 52, thereby altering the legend 26*a* to show its new condition in legend 26*b*, "OPENED".

A suitable alternative to the mechanisms for producing the legends of FIGS. 14 to 16 is to replace the material used to make the cap 10 with one which does not change color when stretched and to replace the external recesses 54 and coating 52 with a printed legend 26*a* in which the letters "UN" are printed with a coating 52 of a contrasting color which will change color when stretched relative to that of the cap proper. The other letters of legend 26 may or may not be printed of materials which do not change color when stretched, as desired. When such an arrangement is used and internal recess 32 underlies the letters "UN", these letters will change color to that of the background color of the cap 10 and the new legend 26*b* will express its new "OPENED" condition.

As stated earlier, the caps 10 of the invention are applied to containers and bottles 13 in packaging operations using standard capping machines and technology. In the illustrative embodiments of the invention we have thus far described, caps 10 which can be placed on the bottles 13 so that the illustrative engaging means, e.g., 24 and 36 of cap 10, meet the corresponding engaging means, e.g., 46 and 44 on the neck 12, for conventional capping operations. In capping the stress is generally compressive, and does not cause significant stretching with a resultant color change. As the cap 10 is removed, however, the cap 10 and neck engaging means impose a tensile stress on the legend portion 26 which stretches the thin sections sufficiently to effect the described change in color.

In the following embodiment (FIGS. 17–23), the capping operation is used to stretch a portion of the legend which evidences sealing, e.g., "SEALED", and the uncapping steps are used to evidence that the seal has been disrupted, e.g., "UNSEALED".

Figure 17:
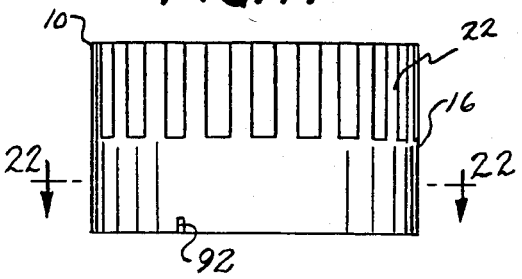
FIG. 17 is an elevational view of another embodiment of the invention showing a cap which provides a means of producing a legend as the container is initially capped and changing that legend upon initial removal of the cap.
Figure 18:
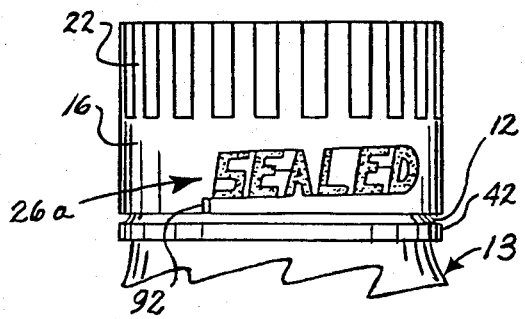
FIG. 18 is an elevational view of the cap of FIG. 17 after securing it to a bottle.
Figure 19:
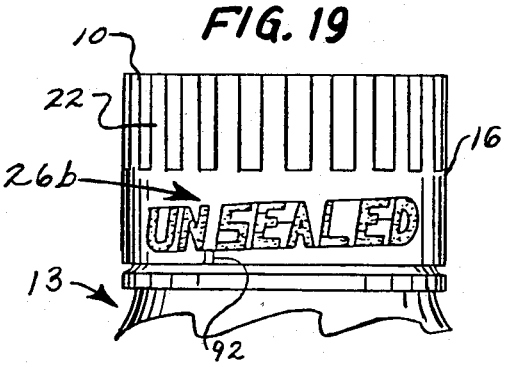
FIG. 19 is an elevational view of the cap of FIGS. 17 and 18 after it has been removed from and reattached to the bottle.

FIGS. 17 to 23 show the cap 10 of FIG. 7 modified to create a legend 26*a* during the initial capping operation indicating its condition, and another legend 26*b* during its initial opening indicating its changed condition. The cap 10 shown in FIGS. 17–19 is made of a plastic which will preferentially stretch and change color. FIG. 17 shows the cap 10 before it is initially placed on the container. FIG. 18 shows the cap 10 on the bottle 13 after the initial capping operation showing the legend 26*a*, "SEALED", and FIG. 19 shows the cap 10 after removal and replacement on bottle neck 12 showing the altered legend 26*b*, "UNSEALED".

Figure 20:
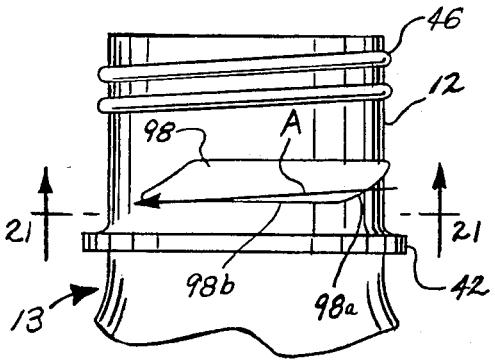
FIG. 20 is an elevational view of the bottle neck of FIGS. 18 and 19.
Figure 21:
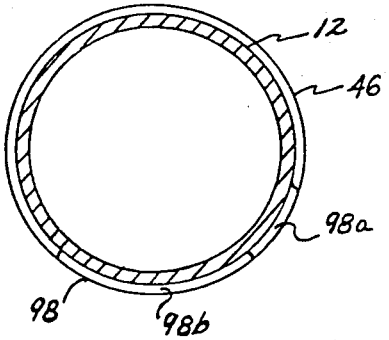
FIG. 21 is a cross-sectional view of FIG. 20 taken along the line 21—21 thereof.
Figure 22:
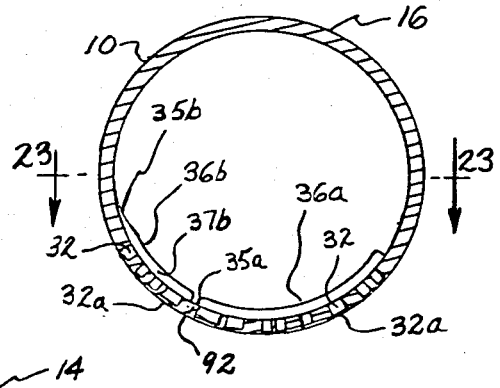
FIG. 22 is a cross-sectional view of FIG. 17 taken along the line 22—22.
Figure 23:
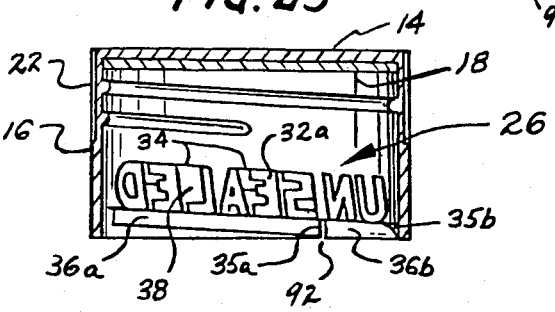
FIG. 23 is a cross-sectional view of FIG. 22 taken along the line 23—23.
Figure 24:
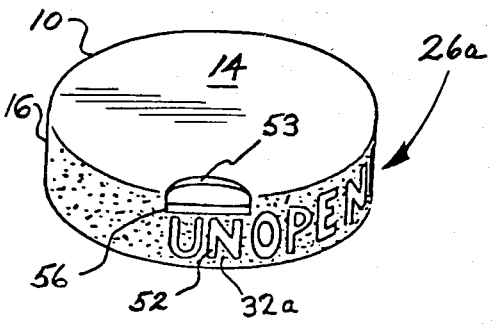
FIG. 24 is a perspective view of a snap fit cap of the present invention prior to opening.
Figure 25:
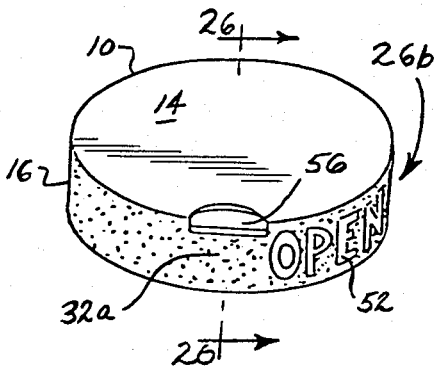
FIG. 25 is a perspective view of the snap fit cap of FIG. 24 after it has been removed from the container.

As shown in FIGS. 20 and 21, the bottle 13 includes a neck 12, threads 46, a neck ring 42 and a lug 98 having a downwardly slanted side portion 98*a* and a horizontal bottom portion 98*b*. As shown in FIGS. 17, 22 and 23, the cap 10 includes a top 14, a liner 18, a skirt 16 having flutes 22, internal threads 24, and a ledge 36 and legend 26 configured as in FIG. 7 except for a notch 92 which divides the ledge 36 into segments 36*a* and 36*b*. The ledges 36*a* and 36*b* include leading edges 35*a* and 35*b* and the ledge 36*b* has a horizontal top surface 37*b*. Above the ledges 36*a* and 36*b* are the thin sections 32*a* for the legends 26*a* and 26*b*.

When the cap 10 is affixed to the bottle neck 12 it is placed over and twisted in a clockwise direction to seat against the neck 12 using the threaded engagement between threads 24 and 46 to develop the requisite seal. As this takes place, the leading edge 35*b* of ledge 36*b* meets the downwardly slanted lug side portion 98*a* using the path of arrow A. The angle the leading edge 35*b* presents to the lug side portion 98*a* is slight so that the ledge 36*b* rides over the side portion 98*a* and is displaced slightly in a radial direction and not at all in a downwardly direction. Therefore, sufficient stretching to produce a color change of the thin recess bottom 32*a* of the "UN" portion of legend 26b does not occur. However, leading edge 35a of ledge 36a presents a sharp angle and significant resistance to lug side portion 98a and as a result is deflected downwardly thereby stretching the thin recess bottoms 32a of the "SEALED" portion of legend 26a and 26b creating the legend 26a on the exterior surface of skirt 16. As the cap 10 is seated, ledge 36b passes over and below lug bottom portion 98b seating itself in that final position using the path indicated by arrow A.

When cap 10 is removed using a counterclockwise twisting action, top surface 37b of ledge 36b engages lug bottom portion 98b presenting a sharp angle creating significant resistance and as a result ledge 36b is deflected downwardly thereby stretching the thin recess bottoms 32a of the "UN" portion of legend 26b creating the altered legend 26b on the exterior surface of skirt 16 indicating and "UNSEALED" condition.

A suitable alternative to the mechanism for producing the legends of FIGS. 17 to 23 is to replace ledge 36a and the recesses 32a above it with a printed legend 26a, "SEALED", on the exterior of skirt 16. Or the cap 10 can be made of plastic which does not change color on stretching and the legends 26a and 26b can be produced using printing materials initially of the same color as the cap 10. In this instance the selected printed materials do change color when stretched and applied above the ledges 36a and 36b on large thin sections 32a which serve as stretchable substrates for the legends 26a and 26b.

Another alternative to the embodiment illustrated by FIGS. 17 to 23 is to maintain its existing configuration except for locating the ledge 36a externally in direct opposition to its original internal location. In this embodiment the legend 26a is produced during the capping operation, such as by using an external sleeve (not shown) which slides over and past skirt 16 to engage the external ledge 36a depressing it sufficiently to stretch and stress whiten the adjacent thin sections 32a to thereby produce the legend 26a.

Figure 26:
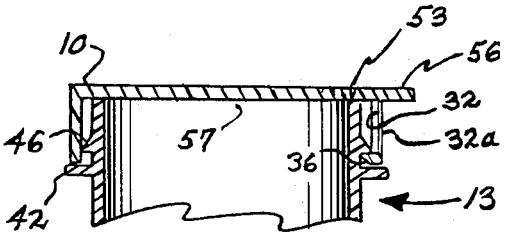
FIG. 26 is a cross-sectional view of FIG. 25 taken along the line 26—26 showing it in engagement with a container.
Figure 27:
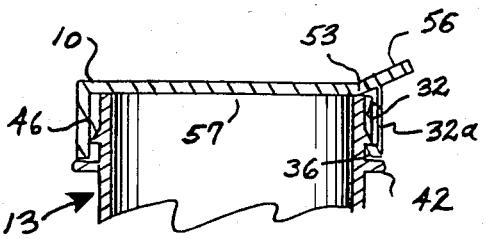
FIG. 27 is a cross-sectional view of the cap as shown in FIG. 26 after the legend portion has been stretched and before it is unseated from the container.
Figure 28:
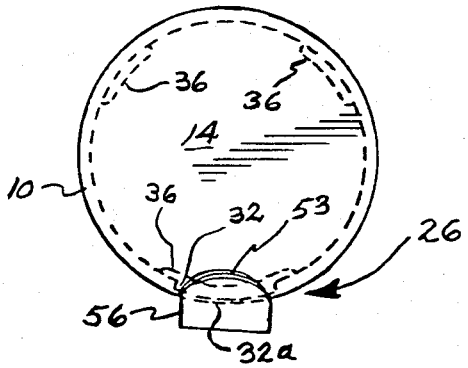
FIG. 28 is a top view of the cap of FIGS. 24 to 27 showing its internal configuration in phantom.
Figure 29:
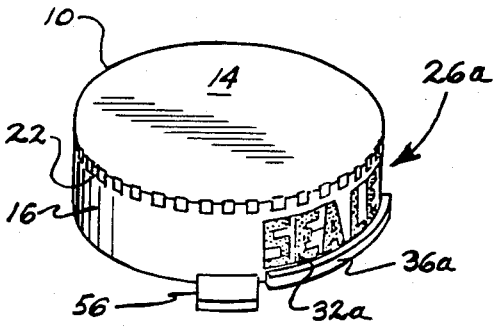
FIG. 29 is a perspective view of another embodiment of the invention illustrating its use in a child resistant snap cap.
Figure 30:
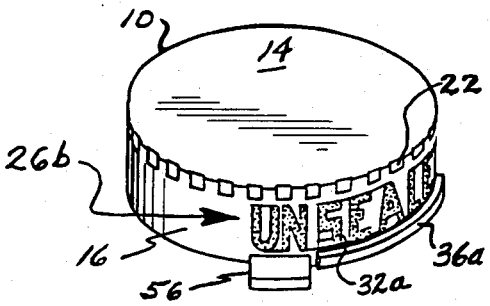
FIG. 30 is a perspective view of the cap of FIG. 29 after it has been removed from its container.
Figure 31:
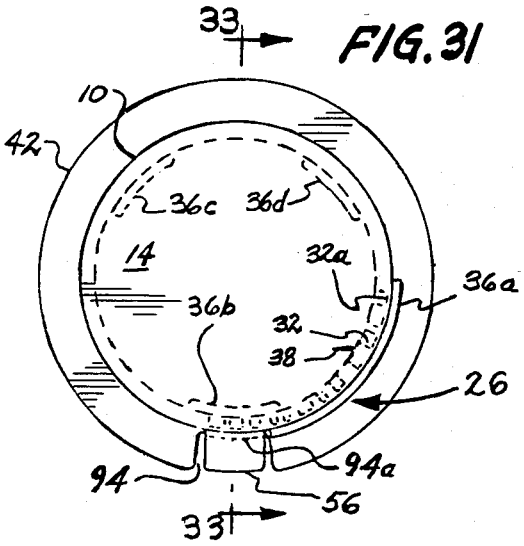
FIG. 31 is a plan view of the cap of FIG. 29 on a container.
Figure 32:
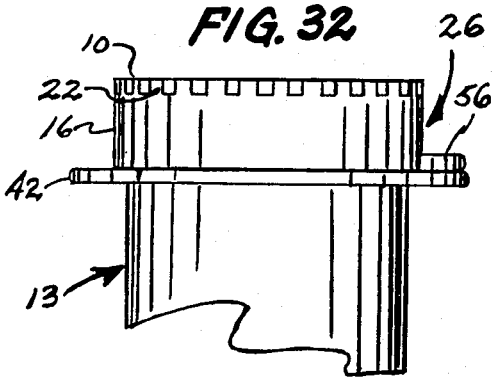
FIG. 32 is a side elevational view of the cap and container of FIG. 31.
Figure 33:
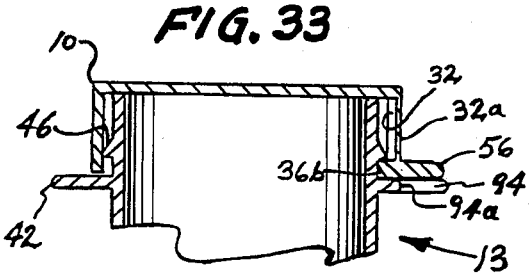
FIG. 33 is a cross-sectional view of FIG. 31 taken along the lines 33—33.
Figure 34:
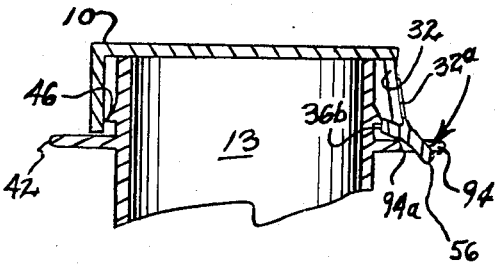
FIG. 34 is another cross-sectional view of the cap and container showing disengagement of the cap.

In FIGS. 24 to 28 is shown an embodiment of the invention wherein a snap cap 10 is provided with the alternative legend arrangement described above for FIGS. 14 to 16. In this case the legend 26 is located on the cap skirt 16 above one of the three internal ledges 36 and under a lift tab 56 which has an arc-shape slot 53 at its root having a V-shape cross section (FIG. 26). The cap 10 is an off-white color and the "UN" portion of the legend 26a is printed in a constrasting color on the exterior surface of skirt 16 opposite an internal recess 32 using a printing material 52 which will opacify to produce the off-white cap color when stretched. The "OPENED" portion of the legend 26a is also printed in a contrasting color and may or may not be printed of a color-changing material. The container 13 is a vial having an external sealing bead 46 near its opening 57 and a ring 42 intended to baffle the bottom of cap 10. In this arrangement when lift tab 56 is pushed upwards, a tensile stress and resultant strain is developed by the interference of cap ledge 36 and vial external sealing bead 46 in the thin recess bottom 32a which stretches and changes the color of the "UN" portion of legend 26a to that of the cap revealing the new legend 26b expressing its "OPENED" condition. As tab 56 is pushed upwards it imposes very little of the lifting force to the cap 10 proper until it has flexed enough so that V-shape slot 53 becomes fully compressed by which point the thin recess bottom 32a is assured sufficient stretching to effect the desired whitening response. At this point the cap 10 is readily removed by the continued lifting action.

A suitable alternative to the legend altering color changing mechanism shown in FIGS. 24 to 28 is to use a darker color cap 10 made of a plastic which opacifies when stretched with white printed lettering 52 so that the background color for the "UN" portion of legend 26a turns a matching shade of white when the cap is opened, thereby leaving the new legend 26b "OPENED".

Another suitable alternative to the legend changing mechanism shown in FIGS. 24 to 28 is to make the cap 10 of a white plastic which does not change color when stretched and to use a similarly colored printed lettering 52 which changes color when stressed by using encapsulated coloring agents for the "UN" portion of the legend 26 and to change the legend 26a to "SEALED" and 26b to "UNSEALED". In this situation lifting the lift tab 56 of cap 10 will produce the letters "UN" to express its new and "UNSEALED" condition.

In FIGS. 29 to 34 there is shown another snap cap 10 of the invention provided with the legend arrangement described for FIGS. 17 to 23. In this case the legend 26a, "SEALED", is located on the cap skirt 16 above the external ledge 36a and the "UN" portion of legend 26b is located above the external lift tab 56 and its internal extension, ledge 36b, which together with internal ledges 36c and 36d is used to engage container 13 external sealing bead 46. As shown, the top surface of external ledge 36a is slightly higher than the top surface of lift tab 56.

The container 13 is a vial having an external collar 42 positioned suitably below external sealing bead 46 so it will baffle the entire lower portion of cap 10 including the lift tab 56 thereby making the cap 10 inaccessible for removal except when tab 56 is rotated to recess 94 provided in collar 42. In this manner the cap 10 is a child resistant closure. As illustrated, the recess 94 has a back portion 94a.

The cap 10 is made of a dark color plastic which will opacify when stretched to produce an off-white colored legend formed by recess bottoms or thin sections 32a.

When the cap 10 is first applied to vial 13 it is snapped into place in conventional fashion and external ledge 36a is depressed by a conventional capping sleeve (not shown) which passes over and down the sides of skirt 16 stretching the thin recess bottoms 32a above external ledge 36a and creating the legend 26a, "SEALED". The sleeve does not contact lift tab 56, thereby preserving the "UN" portion of legend 26b until the cap 10 is removed.

To remove the cap 10 it is first rotated on vial 13 until the lift tab 56 lies above recess 94 in collar 42. Then the lift tab 56 is depressed, tensile stressing the thin sections 32a to cause whitening of the letters "UN" and thereby creating the new legend 26b "UNSEALED". The described tensile stress is created by the leverage developed by the engagement of sealing bead 46 with the lift tab 56 and its extension internal ledge 36b. After lift tab 56 has been depressed sufficiently to contact the collar recess back portion 94a a new leverage mechanism is generated sufficient to unseat the engagement between cap internal ledge 36b and vial sealing bead 46 thereby freeing cap 10 so that it may be easily removed.

If lift tab 56 were to be pressed upwardly in an effort to remove cap 10 from vial 13, the leverage which is generated does not disengage the internal ledge 36b from vial external sealing bead 46. This further increases the difficulty for children to figure out how to remove cap 10, but for adults the process is very simple using the leverage generated by the prescribed removal procedures.

Figure 35:
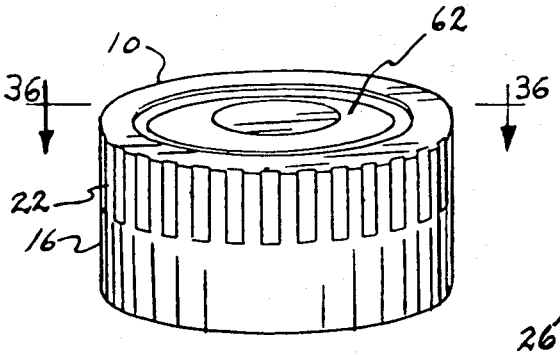
FIG. 35 is a perspective view of another embodiment of the cap of the invention which includes a metal lid and a plastic skirt prior to opening.
Figure 36:
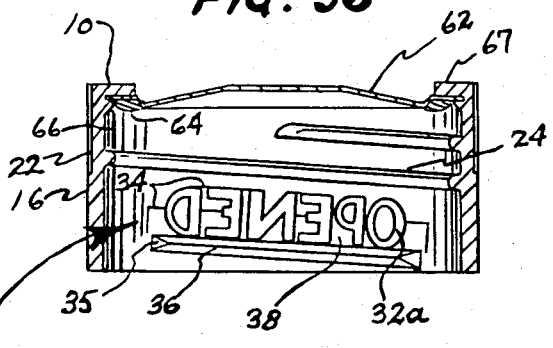
FIG. 36 is a cross-sectional view of FIG. 35 taken along the line 36—36 thereof which shows the legend for the cap upon removal.

In FIGS. 35 and 36 there is shown an embodiment of the invention where the cap 10 of FIG. 7 is modified to include a top 62 which is a metal lid having a soft sealing gasket 64 and supported by flange 67 and projection ledge 66 located on the upper inside periphery of skirt 16. Such an arrangement is especially suited for vacuum packaged products with the legend 26 developing in the same manner as described for FIG. 7.

A suitable alternative to the skirt 16 of FIGS. 35 and 36 is to eliminate ledge 66 so that to remove top 62, skirt 16 must first be removed and top 62 then can be pried off. The legend 26 on skirt 16 is developed in the same manner as for FIG. 7.

Another suitable alternative to the skirt 16 of FIGS. 35 and 36 is to replace the continuous threads 24 with discontinuous threads or projections (not shown) adapted to engage a lug bottle neck finish (not shown) such as is used for many vacuum packed food products.

Figure 37:
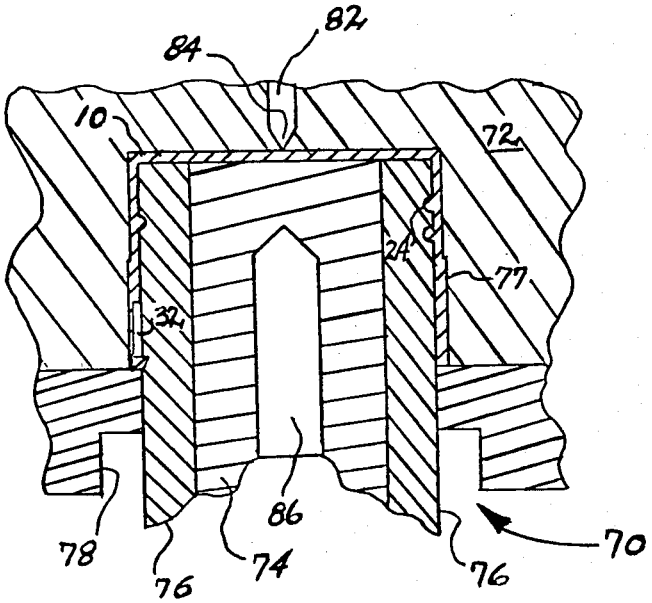
FIG. 37 is a cross-sectional view of an embodiment illustrating a method for manufacture of the cap of the invention.
Figure 38:
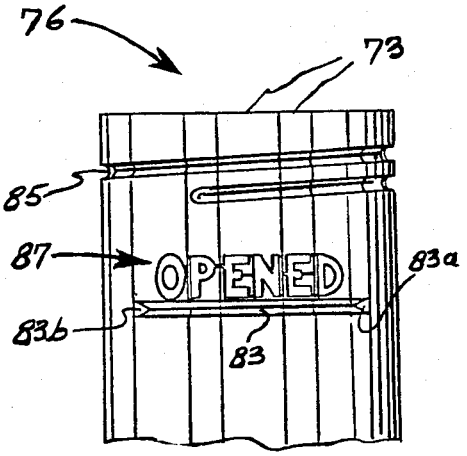
FIG. 38 is an elevational view of the collapsible sleeve of FIG. 37.

FIGS. 37 and 38 illustrate one method for producing the configurations which make up the cap 10 of the invention. Shown is an injection mold 70 including mold portion 72, cavity 77, cap 10 with recess 32 and threads 24, core pin 74 with its cooling hole 86, collapsible sleeve 76, stripper plate 78, runner 82 and gate 84. FIG. 38 shows the collapsing sleeve 76 including its collapsible segments 73 with recessed thread portions 85 and raised legend and ledge portions 87 and 83, respectively, for forming the legend 26 and the finite ledge 36 of cap 10. As shown, the projection or ledge forming portion 83 is finite and is directly beneath the raised legend portion 87 with its leading edge 83*a* extending just in front of the legend portion 87 and the trailing edge 83*b* extending just beyond the legend portion 87.

Plastic material in a suitable melt condition is directed to cavity 77 through runner 82 and cavity gate 84. Cavity 77 is defined by mold portion 72, core pin 74 with its collapsible sleeve 76 and stripper plate 78. After the plastic material has cooled and become rigid, core pin 74 with its collapsible sleeve 76 as well as stripper plate 78 is withdrawn from mold portion 72, carrying with it molded cap 10. During and subsequent this disengagement, core pin 74 effects a further disengagement from its sleeve 76 by an axial displacement which leaves a centrally located recess into which the segments 73 (see FIG. 32) of the collapsible sleeve 76 can move. This radial displacement of the collapsible sleeve 76 clears cap recess 32 and threads 24 thereby freeing cap 10 so that it may be readily removed by stripper plate 78 from the mold 70. U.S. Pat. No. 3,247,548 gives further details on the operation of such a collapsible sleeve.

In the illustrative embodiments, the legends opened or sealed, unopened or unsealed, have been emphasized. It is within the scope of the present invention to provide other legends, symbols, patterns and other indicators, defined and undefined, which reveal the condition of the container.

It is also to be noted that, as shown in the illustrative embodiments, production of a legend by using thin sections defining the legend surrounded by adjacent thick sections and using a molded cap of material which changes color on stretching is interchangeable with the production of a legend by using thick portions which define the legend surrounded by thin portions which provide a background contrasting color when stretched; or by using a cap made of material which does not change color on stretching with thin portions which define the legend when stretched and a coating thereon which will change color on stretching; or by using a cap made of material which does not change color on stretching having thin background portions upon which the legend is printed from materials which will change color on stretching.

The stress whitening or opacifying plastic of the invention can be selected from a group of transparent or opaque polymers which, when stretched, develop an increased opacity which masks the color of any substrate and/or washes out the intensity of any colorant dispersed throughout. In general, when such a plastic is the single component of a cap, the unstressed color selected will be of medium to dark shades and the stressed portions thereof will show up as an off-white color of the same tint as the darker background color. When such a plastic is used as a top strata of a non stress-whitening substrate, it may be transparent or colored as the substrate so that before stretching it is not noticeable, but when stretched it will show up as white against the unstretched background color which desirably is darker. When it is desired to obliterate a portion of a legend describing the precondition of the bottle to express its new condition, such a plastic used as a top strata (e.g., a printed coating) may be a dark shade whose opacified or whitened color upon stretching matches the color of the surrounding substrate which is lighter. Other colors and color combinations may be desired and used which complement and practice the invention.

Useful plastics for accomplishing the stress whitening of the invention include such polymer blends as elastomer modified polymethylmethacrylates, polystyrenes, styrene-acrylonitrile polymers (e.g., acrylonitrile-butadiene-styrene polymers), polypropylenes, polyethylenes and other multi-phase plastics wherein stretching produces phase separation and resultant light diffraction and opacification.

When the color change which produces the legend of the invention is based on a dispersion of microencapsulated coloring agents, said agents may be dyes, solution of dyes or reactants which when contacting similarly dispersed chemicals in the plastic matrix form a colored product. The encapsulating shell for the color agent may be of a variety of polymeric materials including gelatins and synthetic polymers. The shells may be precipitated onto the inner colorant as a gelatin as taught by U.S. Pat. Nos. 2,183,053, 2,800,457 and 2,800,458. Or the shells may result from the reaction of water soluble materials such as urea formaldehyde prepolymer in the presence of an emulsified colorant as taught in U.S. Pat. Nos. 3,935,960 and 3,516,846. The matrix for the encapsulated colorant should have sufficient strength to be able to transform the tensile stress imposed on it into a compressive force on the capsules sufficient to crush them. Such high modulus plastics as polypropylene, high density polyethylene, elastomer modified and unmodified polystyrenes and acrylics and other polymers are generally suitable.

The cap of the invention may be fabricated by a variety of molding methods, including injection molding, compression molding, transfer molding, forging and stamping. (See *Modern Plastics Enyclopedia*, Vol. 56, Number 10A 1979 pages 252–256, 308–331, 345–347 and pages 410–415.)

With respect to the caps of the present invention, they can be used with the full range of molded container neck finishes including continuous thread, snap-fit and lug or interrupted thread cap-engaging means. These caps may also be of one-piece construction consisting of both top and skirt or of a plurality of components including at least a top or lid and a skirt which may be separate or engaged with said top or lid.

The caps of the present invention may be used to close a wide range of containers including narrow neck bottles, wide mouth jars, vials, bags with molded necks, carboys, drums, etc., which may contain a wide variety of liquid and dry products including:

beverages, such as soft drinks, beer, fruit juices and drinks, milk, liquor and wine;

medicinal and health products, such as analgesics, oral antiseptics, antacids, cough remedies, etc.;

food, such as ketchup, vinegar, edible oils, mayonnaise and other pickled or processed foods; and toiletries and cosmetics, such as hair and skin care products.

The invention in its broader aspects is not limited to the specific described embodiments and departures may be made therefrom within the scope of the accompanying claims without departing from the principles of the invention and without sacrificing its chief advantages.

I claim:

1. A tamper evident cap for a container having an opening for dispensing its contents and engaging means about the opening, comprising a resealable substantially rigid cap for closing, opening and reclosing the container having a portion of plastic with a recess therein which forms a thin section about which is a thicker section, wherein said thin section stretches preferentially upon the application of tensile stress thereto to effect a color change in the cap, and mechanical means thereon adapted to engage the engaging means to the container and coact therewith to preferentially stretch said thin section to effect a change in color for indicating the condition of the container.

2. The tamper evident closure of claim 1, wherein said thin section stress whitens upon tensile stressing.

3. A tamper evident closure for a container having an opening for dispensing its contents, comprising a resealable cap having a skirt adapted to extend about the periphery of the container for closing, opening and reclosing thereof, means integral with said skirt which comprise plastic and which effect a color change upon stretching, and mechanical means on said cap which engage the container about its opening to stretch said color changing means as said cap is being removed to indicate that the container has been opened.

4. A tamper evident closure for a container having an opening for dispensing its contents, comprising a resealable cap having a skirt adapted to extend about the periphery of the container for closing, opening and reclosing thereof, means integral with said skirt which comprise plastic and which effect a change in color upon stretching, and mechanical means on said cap for stretching said color changing means as said cap is placed on the container to indicate that the container is closed.

5. A tamper evident closure for a container having an opening for dispensing its contents, comprising a resealable cap having a skirt adapted to extend about the periphery of the container for closing, opening and reclosing thereof, means integral with said skirt which comprise plastic and which effect a color change upon stretching, and mechanical means on said cap for stretching a portion of said color changing means as said cap is placed thereon to indicate that the container is closed and for stretching another portion of said color changing means as said cap is being removed to indicate that the container has been opened.

6. The tamper evident cap of claims 3, 4 or 5, wherein said color changing means includes a thin section in said plastic which stretches preferentially to effect a change in color upon the application of tensile stress by said mechanical means, and a thicker section in said plastic adjacent said thin section which remains substantially unstretched and does not change color when said thin section is stretched.

7. The tamper evident cap of claim 6, wherein said thin section changes color when stretched to indicate the condition of the package.

8. The tamper evident cap of claim 6, wherein said thin section changes color when stretched and serves as background for said thick section which indicates the condition of the package.

9. The tamper evident cap of claim 6, wherein said thin section has a coating thereon which changes color when stretched by the stretching of said underlying thin section to indicate the condition of the package.

10. The tamper evident cap of claim 6, wherein said thin section has a coating thereon which defines a legend that changes color when stretched by stretching of said underlying thin section to indicate the condition of the package.

11. A resealable tamper evident cap for closing, opening and reclosing a container and for indicating the condition of the container by a change in color, comprising:

a portion of plastic having recesses which form thin sections and which preferentially stretch upon the application of tensile stress thereto to effect a color change therein, thicker sections about and contiguous with said thinner sections which remain substantially unstretched and do not effect a color change therein when tensile stress is applied to said thinner sections, and mechanical means on said cap for coacting with the container for capping and uncapping to open and close the container, and for preferentially stretching said thin sections to effect a color change which indicates the condition of the container.

12. The tamper evident cap of claim 11, wherein said thinner sections define a legend which whitens upon stretching by said mechanical means to indicate the condition of the package.

13. The tamper evident cap of claim 11, wherein said thinner sections define a legend which upon stretching indicates that the container has been opened, and wherein said mechanical means coact with said container to stretch said legend as said cap is removed to indicate the container has been opened.

14. The tamper evident cap of claim 11, wherein said thinner sections define a legend which upon stretching indicates the container is closed, and wherein said mechanical means stretches said legend as said cap is initially applied to indicate the container is closed.

15. The tamper evident cap of claim 11, wherein said thinner sections define a legend which upon sequential stretching indicate that said cap is closed and that thereafter it has been opened, and wherein said mechanical means is adapted to sequentially stretch said legend to indicate the condition of the container.

16. The tamper evident cap of claim 11, wherein said thin sections are biased away from the direction of the stress applied thereto to facilitate stretching.

17. The tamper evident cap of claim 11, wherein a coating is on said thin sections which will change color when stretched and which will stretch with said underlying thin sections.

18. The tamper evident cap of claim 17, wherein said coating stress whitens.

19. The tamper evident cap of claim 17, wherein said coating includes an encapsulated coloring agent, the encapsulation of which will rupture upon stretching to release the agent and effect the color change.

20. The tamper evident cap of claim 11, whrein said mechanical means includes a projection adapted to engage the container for stretching thinner sections and effect the change in color for indicating the condition of the package.

21. The tamper evident cap of claim 20, wherein said cap is a twist cap.

22. The tamper evident cap of claim 20, wherein said cap is a snap cap.

23. A resealable tamper evident cap for closing, opening and reclosing a container and for indicating the condition of the container by a change in color, comprising:

a top and a depending skirt of plastic, internal recesses in said plastic skirt which form thin sections and which preferentially stretch upon the application of tensile stress thereto to effect a color change in the skirt, thicker sections in said plastic skirt surrounding said thinner section which remain substantially unstretched and do not change color when tensile stress is applied to said thinner sections, mechanical means on the cap above said thin sections for cooperating with the container to open and close it by movement of the cap, and an internal projection means on said skirt underlying said thin sections for forming an interference with the container which preferentially stretches said thin sections upon a preselected movement of the cap to indicate the condition of the container.

24. The tamper evident cap of claim 23, wherein said mechanical and said internal projection means effect a color change which spells the word "opened" of its equivalent upon the initial removal of said cap from the container.

25. The tamper evident cap of claim 23, wherein said mechanical and internal projection means effect a color change which spells the word "sealed" or its equivalent upon the initial closing of the container.

26. The tamper evident cap of claim 23, wherein said mechanical and internal projection means effect a color change when the cap initially closes the container to indicate that the container is closed and a further color change when the cap is initially removed from the container to indicate that the container has been opened.

27. The tamper evident cap of claim 23, wherein said thick portions about said thin portions in the skirt inhibit a change in color when the cap is under compression, and where transverse slots are provided in said thick sections which are about said thinner sections for allowihg said thick portions to move apart easily to facilitate stretching of said thin sections and effect the change in color when the cap is under tension.

28. The tamper evident cap of claim 23, wherein said cap is a twist cap, and wherein said projection reinforces said thin sections against circumferential stretching in moving the cap relative to the container but not vertical stretching of said thin sections caused by such relative movement.

29. The tamper evident cap of claim 23, wherein said mechanical means include internal threads on said skirt which are above said thinner sections for opening and closing a container.

30. The tamper evident cap of claim 23, wherein said mechanical means include internal lugs on said skirt and which are above said thinner sections for opening and closing a container.

31. The tamper evident cap of claim 23, wherein said mechanical means includes a tab extending therefrom for opening and closing a container.

32. The tamper evident cap of claim 23, wherein said projection is a finite ledge which extends inwardly and circumferentially, and varies in its radial dimensions.

33. A tamper evident package, comprising:

a container having an opening for dispensing the contents of the package, a resealable substantially rigid closure for closing, opening, and reclosing the container, color changing means operatively connected to said closure which changes color upon stretching, and coacting mechanical means on said closure and on said container for uncapping and recapping said closure and for stretching said color changing means to effect the change in color which indicates the condition of the package.

34. A tamper evident package, comprising:

a container having an opening for dispensing the contents thereof, a resealable cap having a depending skirt about the periphery of said opening wherein said cap closes, opens and recloses the container, a stretchable portion of relatively thin plastic in said skirt which effects a change in color when stretched, and coacting mechanical means on said cap and on said container for uncapping and recapping said cap and for stretching said portion to produce a color change which indicates the condition of the package.

35. A tamper evident package having a container and cap and comprising:

a container having an opening therein for dispensing contents, external engaging means on the container and about the periphery of said opening for releasably securing the cap thereon, and external projection means on the container below said engaging means, and a cap having a depending skirt with internal engaging means which cooperate with the engaging means on said container for opening and closing the container, means integral with said skirt made from plastic and including a recess therein that forms a thin section which effects a change in color upon stretching, and internal projection means below said color changing means which contact said external projection means and produce an interference therebetween that imparts tensile stress to said color changing means as said cap is moved to produce a change in color which indicates the condition of the package.

36. The tamper evident package of claim 35, wherein said color changing means includes a plurality of said thin sections that effect a color change which spells the word "opened" or its equivalent upon the initial removal of said cap from the container.

37. The tamper evident package of claim 35, wherein said color changing means includes a plurality of thin sections that effects a color change which spells the word "sealed" or its equivalent upon the initial closing of said cap on the container.

38. The tamper evident package of claim 35, wherein said color changing means includes a plurality of thin sections that effect a color change which spells the word "sealed" or its equivalent upon the initial closing of said cap on the container, and which spells the word "unsealed" or its equivalent upon the initial removal of said cap from the container.

39. The tamper evident package of claim 35, wherein said engaging means on said container and skirt are threads and the motion needed to twist said cap is translated into tensile stress by the interference between said internal and external projection means.

40. The tamper evident package of claim 35, wherein said internal projection means on said skirt is at an angle to the horizontal so that said internal projection engages said external projection means in a point by point manner to minimize the force needed to overcome the interference therebetween while producing the required tensile stress to effect a change in color.

41. The tamper evident package of claim 35, wherein said external projection means includes a release which is engaged by said internal projection means as said cap is removed to thereby facilitate a change in color and removal of said cap.

42. A tamper evident package, comprising:

a container having an opening therein for dispensing contents, a snap cap having a skirt with means integral therewith made from plastic and including a recess therein which forms a thin section that effects a change in color upon tensile stressing, and coacting means on said container and cap to impart a tensile stress to said thin section to effect a change in color that evidences the condition of the container.

43. The tamper evident package of claim 42, wherein said cap includes a tab to effect the tensile stressing of said thin section.

44. A tamper evident bottle and cap, comprising:

an externally threaded neck finish on the bottle having an opening for dispensing its contents, and an external projection below said external threads, a plastic cap having a top and depending skirt with internal threads for engagement with said external threads for closing, opening and reclosing said bottle, internal recesses in said plastic skirt and below said internal threads which form thin sections and which preferentially stretch and stress whiten upon the application of tensile stress thereto, thicker sections in said plastic skirt about and contiguous with said thin sections which remain substantially unstretched and do not change color when tensile stress is applied to said thin sections, transverse slots in said thick sections which are between said thin sections to facilitate stretching of said thin sections, and an internal projection on said skirt underlying said recesses which forms an interference with said external projection as said cap is removed for preferentially stretching and stress whitening said thin sections to indicate the bottle has been opened.

45. A tamper evident bottle and cap, comprising:

an externally threaded neck finish on the bottle having an opening for dispensing its contents, and an external projection below said external threads, a plastic cap having a top and depending skirt with internal threads for engagement with said external threads for closing, opening and reclosing said bottle.

internal recesses in said plastic skirt and below said internal threads which form thin sections and which preferentially stretch and stress whiten upon the application of tensile stress thereto, and wherein said recesses are biased away from the direction of said stress to facilitate stretching of said thin sections, thicker sections in said plastic skirt about and between said thinner sections which remain substantially unstretched and do not change color when tensile stress is applied to said thinner sections, transverse slots in said thick sections which are between said thin sections to facilitate stretching of said thin sections, and an internal projection on said skirt underlying said recesses which is biased away from the lower edge of said external projection and which engages said external projection means in a point by point manner as said cap is being removed to minimize the force needed to overcome the interference therebetween while producing the required tensile stress for preferentially stressing and stress whitening said thin sections to indicate the bottle has been opened.

46. The bottle and cap of claims 44 or 45, wherein said external projection includes means thereon for engaging said internal projection to provide the requisite interference therebetween for producing the desired color change and for thereafter releasing said internal projection to facilitate removal of said cap.

47. The tamper evident bottle and cap of claims 44 or 45, wherein said top is a metal lid attached to said skirt, and wherein said bottle and cap are used as a vacuum package.

48. A tamper evident bottle and cap, comprising:

a neck finish on the bottle having an opening for dispensing contents, a plastic cap having a top and a depending skirt for opening, closing and reclosing said opening, coacting mechanical means on said skirt and neck finish for capping and uncapping said cap to close and open the container, internal thick sections in said skirt which define a legend to indicate that the cap has been removed to open the bottle, an internal thinner portion in said skirt surrounding and between said thick sections which preferentially stretch upon the application of tensile stress thereto to stress whiten said thin portions and thereby produce the legend defined by said thicker sections, an external projection on said neck finish spaced from and below its coacting means, and an internal projection on said skirt below said thin portion for forming an interference with said external projection as said cap is being removed to preferentially stretch and stress whiten said thin portion and thereby produce the legend defined by said thick portions to indicate the bottle has been opened.

49. A tamper evident bottle and cap, comprising:

a neck finish on the bottle having an opening for dispensing contents, a plastic cap having a top and a depending skirt for opening, closing and reclosing said opening, mechanical interengaging means on said skirt and neck finish for capping and uncapping said cap to close and open the container, an external legend on said skirt which spells UNOPENED when the cap is initially applied to said neck finish to close the bottle, an internal thin portion in said skirt behind the UN portion of the external legend which preferentially stretches upon the application of tensile stress thereto and whitens the UN portion of the legend, a coating on the skirt surrounding the UNOPENED legend which is the same color as a whitened UN portion, and coacting color changing means on said cap and said neck finish which preferentially stretch and whiten the UN portion upon initial removal of said cap to change the legend from UNOPENED to OPENED to indicate that the bottle has been opened.

50. The tamper evident bottle and cap of claim 49, wherein said color changing means, comprises:

an external projection on said neck finish spaced from and below its engaging means, and an internal projection on said skirt underlying said UN portion of the legend which engages said external projection to form an interference therewith for preferentially stretching and whitening the UN portion upon the initial removal of the cap to change the legend to OPENED to indicate that the bottle has been opened.

51. The tamper evident bottle and cap of claim 49, wherein said interengaging means are below said legend, and wherein a lifting tab extends from said cap above the UN portion of said legend and preferentially stretches and whitens said portion upon the initial removal of the cap.

52. A tamper evident bottle and cap, comprising:

a neck finish on the bottle having an opening for dispensing contents, a plastic cap having a top and a depending skirt for opening, closing and reclosing said opening, coacting mechanical means on said skirt and neck finish for capping and uncapping said cap to close and open the container, internal recesses in said skirt below its coacting means which form thin sections and which preferentially and selectively stress whiten when tensile stress is applied thereto to define the word SEALED when the cap is initially applied to and closes said bottle and to change the word to UNSEALED when the cap is initially removed to open said bottle, an external projection on said neck finish below its coacting means, and an internal projection means underlying said thin sections which engages said external projection to form an interference therewith as said cap is initially applied to the bottle to selectively stretch and stress whiten only said thin sections which define SEALED to indicate the bottle is closed, and which engages said external projection to form an interference therewith as said cap is initially removed from the bottle to stretch and stress whiten said thin sections which define UN to produce UNSEALED which indicates the bottle has been opened.

53. A child resistant, tamper evident container and cap, comprising:

a finish on the container end having an opening for dispensing its contents, a plastic snap cap having a top and a depending skirt for opening, closing and reclosing said opening, coacting means on said skirt and said finish which allow the rotation of said cap relative to said container without permitting removal thereof unless there is a preselected registry between said coacting means, internal recesses in said skirt above its coacting means which form thin sections and which preferentially and selectively stress whiten when tensile stress is applied thereto to define the word SEALED when the cap is initially applied to and closes said container and to change the word to UNSEALED when the cap is initially removed to open said container, an external projection below said thin sections which define SEALED and extending therefrom, and wherein said projection is depressed after said cap is initially applied to the container to stretch and stress whiten said thin sections so that SEALED appears on the cap of the closed container, and a tab below said thin sections which defines UN and extending therefrom, and wherein, when said coacting means are in proper registry for opening, said tab is positioned for deflection downwardly to stretch and stress whiten said thin sections thereabove so that UN appears with SEALED on the cap as it disengages from said container to indicate the container has been opened.

* * * * *